US010729228B1

(12) United States Patent
Jensen

(10) Patent No.: US 10,729,228 B1
(45) Date of Patent: Aug. 4, 2020

(54) MECHANICAL CASE ATTACHMENT FOR HANDHELD ELECTRONIC DEVICES

(71) Applicant: HACKD LLC., Whitefish Bay, WI (US)

(72) Inventor: Danin Jensen, Whitefish Bay, WI (US)

(73) Assignee: HACKD LLC., Fort Lauderdale, FL (US)

( * ) Notice: Subject to any disclaimer, the term of this patent is extended or adjusted under 35 U.S.C. 154(b) by 519 days.

(21) Appl. No.: 15/370,131

(22) Filed: Dec. 6, 2016

Related U.S. Application Data

(60) Provisional application No. 62/285,027, filed on Dec. 8, 2015.

(51) Int. Cl.
*A45F 5/10* (2006.01)
*A45C 11/00* (2006.01)

(52) U.S. Cl.
CPC ..... *A45F 5/10* (2013.01); *A45C 11/00* (2013.01); *A45C 2011/002* (2013.01); *A45C 2011/003* (2013.01); *A45C 2200/15* (2013.01)

(58) Field of Classification Search
CPC ..... A45C 2200/15; A45C 11/00; A45C 2011/002; A45C 2011/003; A45F 5/10; A45F 2200/0516; H04B 1/3877; H04M 1/04
USPC ..... 224/217
See application file for complete search history.

(56) References Cited

U.S. PATENT DOCUMENTS 7,301,759 B2 * 11/2007 Hsiung ..... H05K 5/0234 248/188
7,916,478 B2 * 3/2011 Tu ..... F16M 11/10 248/398
2016/0094694 A1 * 3/2016 Ahn ..... H04M 1/0237 455/575.4

* cited by examiner

*Primary Examiner* — Nathan J Newhouse
*Assistant Examiner* — Matthew T Theis
(74) *Attorney, Agent, or Firm* — The Concept Law Group, PA; Scott M. Garrett; Scott D. Smiley

(57) ABSTRACT

A mechanical assembly disposed on the back surface of a handheld electronic device, or a case for holding such a device, provides a pinky finger extension for an individual's hand to use an electronic device comfortably and with decreased possibility of dropping or damaging the electronic device. The pinky finger extension can be moved between a closed position, where it is inaccessible, and an open position where the user can place their fourth or pinky finger over the pinky finger extension.

13 Claims, 7 Drawing Sheets

MECHANICAL CASE ATTACHMENT FOR HANDHELD ELECTRONIC DEVICES

CROSS REFERENCE

This application is a non-provisional application conversion of, and claiming priority to, provisional application No. 62/285,027, which was converted to a provisional application on Jul. 26, 2016 from a non-provisional application filed Dec. 8, 2015, the entirety of which, and all papers filed therewith and in connection thereto, are hereby incorporated by reference.

FIELD OF THE DISCLOSURE

The present disclosure relates generally to portable handheld electronic device, and more particularly to a case for a portable electronic device that provides a finger rest for an individual's finger to securely hold the electronic device comfortably and to decrease the risk of accidently dropping the electronic device.

BACKGROUND

Portable, handheld electronic devices such as cellular phone device are in widespread usage. Typically such devices include a computer operating system, display, and input means to allow a user to interact with, and operate the device. It is now common for people to carry such devices with them, and manufacturers have sought to design the devices to be thin, and fit in the hand. Generally they are rectangular, and require being held in one or both hands while input is accomplished by use of the free hand, or thumbs of both hands. The profile of these devices, however, makes them somewhat awkward to hold, and it is not uncommon for people to drop their device, which can cause damage to the device.

To address the problem of holding a handheld device while using it, some manufacturers have designed cases that increase the profile and size of the device, and can even include features like rubberized exteriors to enhance a user's grip on the device. Although such cases can enhance the ability of a user to hold a device, it does not change the general profile of the device, which is a substantially rectangular object, only makes it a slightly larger, thicker rectangular object. Such cases offer no particular features other than making the device effectively larger.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
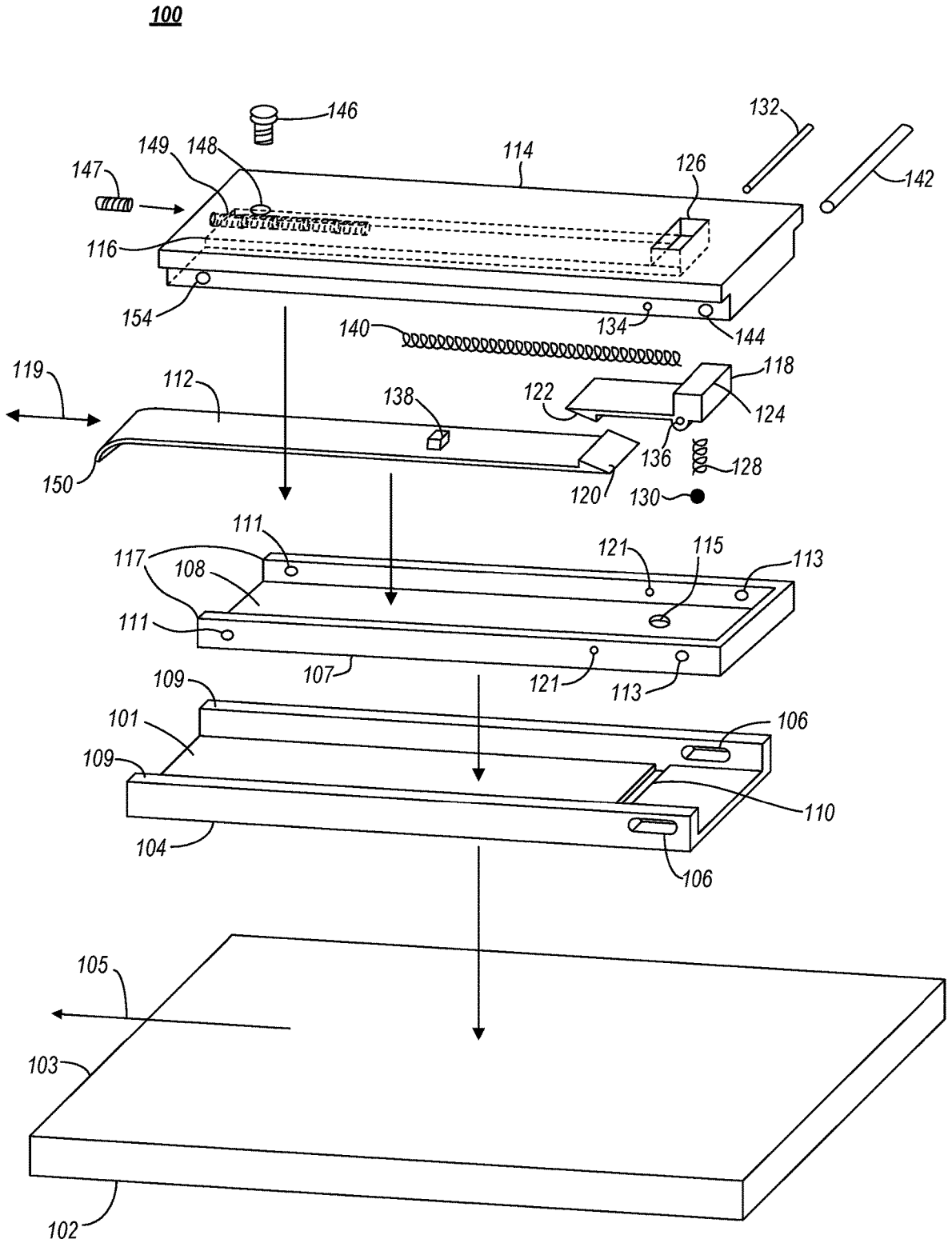
FIG. 1 is an exploded isometric view of a mechanical assembly for a case attachment for a handheld electronic device, in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

The various embodiments of the disclosure in general provide a finger grip that allows a user of handheld device, to which the inventive finger grip is attached, or in which it is integrated, to more securely hold and retain the handheld electronic device while operating it. Some embodiments of the disclosure describe an assembly for a handheld electronic device that includes a mounting plate engaged on a bottom surface of the handheld electronic device. The mounting plate has opposing walls with opposing slotted holes at a first end of the mounting plate. The assembly can further include a stand portion in pivoting engagement with the mounting plate by a pivot rod extending through the opposing slotted holes with a top portion disposed over, and coupled to, the stand portion. A guide channel is formed between the stand portion and the top portion. The assembly further includes a sliding tab in sliding engagement in the guide channel. The sliding tab has a finger rest that extends in a direction opposite from the first end. The assembly further includes a pivoting button having an actuation portion extending through a surface of the top portion. The pivoting button has a retaining features that retains the sliding tab in a closed position, and can be actuated via the actuation portion to disengage the sliding tab to allow the sliding tab to move into an open position where the finger rest is accessible to a user's finger when holding the handheld electronic device.

FIG. 1 is an exploded isometric view of a mechanical assembly for a case attachment for a handheld electronic device 102, in accordance with some embodiments. The handheld electronic device 102 can be, for example, a cellular telephone device, a tablet computing device, or any other device that can be held in a user's hand, or a case for such a device, and can have a generally flat, rectangular form factor. As shown here, the handheld electronic device 102 is face down, with the backside of the device 102 being the major surface in view. Above the handheld device 102 is a mechanical case attachment assembly that allows a user to better hold and operate the handheld device when the mechanical case attachment is assembled and in place on the back of the handheld electronic device 102. The assembly includes a mounting plate structure 104 which is attached to the back of the handheld electronic device 102 (i.e. via adhesive means, or being integrated into a case or the electronic device itself). The mounting plate 104 generally has a longitudinal axis that is aligned with an axis of the handheld electronic device 102, and bed channel 101 that is bounded by opposing walls 109 on either side of the bed channel 101. A pair of opposing slotted holes 106 are formed in the opposing walls 109 at a first end of the mounting plate 104, and a cross groove or slot 110 runs across the width of the bed channel 108 near the first end, but farther away from the first end than are the opposing slotted holes 106.

Disposed in the bed channel 101 is a stand portion 107 that has a guide channel 108 formed between two opposing walls 117 that, when the stand portion 107 is assembled into the mounting plate 104, are vertically even with opposing walls 109. The stand portion has a pair of opposing stand pivot holes 113 located in opposing walls 117 in correspondence with slotted holes 106, and a pair of opposing button pivot holes 121. The stand portion 107, and all other components assembled into the stand portion 107, can, upon being assembled, pivot around a stand pivot pin 142 that passes through opposing stand pivot holes 113 and opposing slotted holes 106 (among other components, as will be discussed). The stand pivot rod 142 can move in the slotted holes 106, allowing the stand portion 107 and other components assembled into the stand portion 107 to be swung out so as to form a standing support for the handheld electronic device 102.

A sliding tab 112 is captured between the opposing walls 117 in the guide channel 108, allowing the sliding tab 112 to move along the longitudinal axis in the guide channel 108, as indicated by arrow 119. The sliding tab 112 has, at a first end, a releasable retention feature 120 such as, for example, a ramped surface that terminates with a vertical catch surface. The sliding tab further includes a finger retention feature 150 at the second end, opposite the first end having the retention feature 120. The finger retention feature 150 is a portion of the sliding tab 112 that protrudes, when deployed, beyond the bottom 103 of the handheld electronic device 102, in the direction of arrow 105 to provide a location in which to place the pinky finger of the hand holding the handheld electronic device 102. In some embodiments the finger retention feature 150 can include a curved or angled portion of the sliding tab 112 to provide more surface against which the user's pinky finger can bear for additional retention. The sliding tab 112 further include raised portion 138 against which an actuation spring 140 bears.

The sliding tab 112 is further captured in the guide channel 108 by a top portion 114, which fits over the mounting plate 104, provides features for retaining the sliding tab 112 and a button assembly that actuates motion of the sliding tab 112 within the guide channel along the longitudinal axis. The button assembly includes a pivoting button 118 having an actuation portion 124 that is raised and fits through a button hole 126 in the top portion 114. The pivoting button is retained by the button pivot pin or rod 132 that passes through a pivot hole 136 of the pivoting button, as well as corresponding holes 134 in the top portion and holes 121 in the stand portion 107. The pivoting button 118 further include a retaining ramp feature 122 that corresponds to the retention feature 120 of the sliding tab 112. The retaining ramp feature 122 can be a ramp-shaped portion that is inverted with respect to the retaining feature 120. As the sliding tab is moved towards the button, the retaining feature 120 slides under the retaining ramp feature, pushing the retaining ramp feature up, until the back ends pass, and then the retaining ramp feature 122 is biased downwards by a button spring 128 on the other side of the pivot rod 132 location, creating an interference between the back ends of ramps 120, 122, until the actuation portion 124 of the button is pushed down. The button spring 128 is held at a top end in the actuation portion 124 and hold a half ball bearing 130 at a lower end of the button spring 128. The half ball bearing mates with a cross slot 110 formed in the bed channel 108 of the mounting plate 104, through corresponding hole 115 in the stand portion, and acts as a detent when the stand portion 107 and other components are swung out to act as a stand.

The actuation spring 140 is captured between the actuation portion 124 of the button 118 and the raised potion 138, thereby biasing the sliding tab 112 away from the button 118. When the actuation portion 124 is pressed down, the ramp portions 120, 122 separate, and the force of the actuation spring 140 moves the sliding tab so that the finger retention portion 150 of the sliding tab extends outward. The raised portion 138 then bears against a stopping feature such as a set screw 146 in set screw hole 148. The user, when finished using the finger retention portion 150, can simply push the sliding tab back into the guide channel 108 so that ramp 120 is then retained by ramp 122 of the button 118.

The set screw 146 is set into the set screw hole 148 in the top portion 114. The top portion further captures the sliding tab 112 in the guide channel 108, and has a corresponding channel 116. Pivot stand pin 142 passes through hole 144 and button pivot pin 132 passed through holes 134 on other side of button hole 126 in the sided of the top portion 114. The set screw 146 is shown here in a vertical orientation, but can alternatively be a headless set screw 147 disposed horizontally in the top portion 114 in a threaded channel 149 parallel to the corresponding channel 116 along the longitudinal axis of the top portion 114. The top portion is therefore held in the stand portion 107 by stand pivot pin 142, at the first (right, on the drawing) end, and can be held using a small screw through holes 111, 154 on each side of the channels 108, 116, thereby allowing the stand portion 107, sliding tab 112, top portion 114, and button 118 to be moved and operated as a unit in mounting plate 104.

Figure 2:
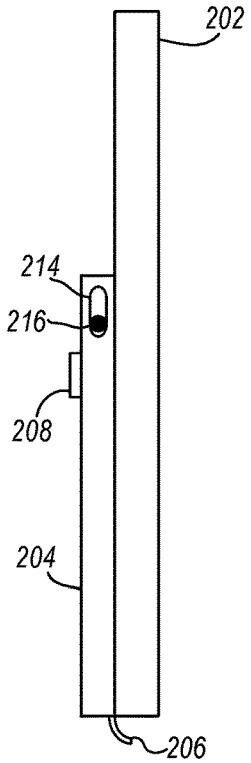
FIG. 2 is a side elevational view of a handheld electronic device with a case attachment having pinky finger extension withdrawn, in accordance with some embodiments.
Figure 3:
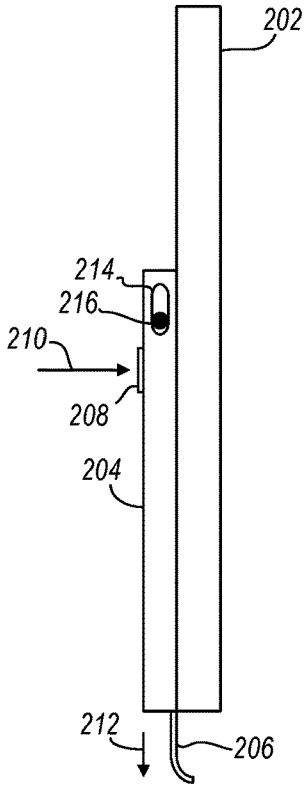
FIG. 3 is a side elevational view of a handheld electronic device with a case attachment having pinky finger extension extended, in accordance with some embodiments.
Figure 4:
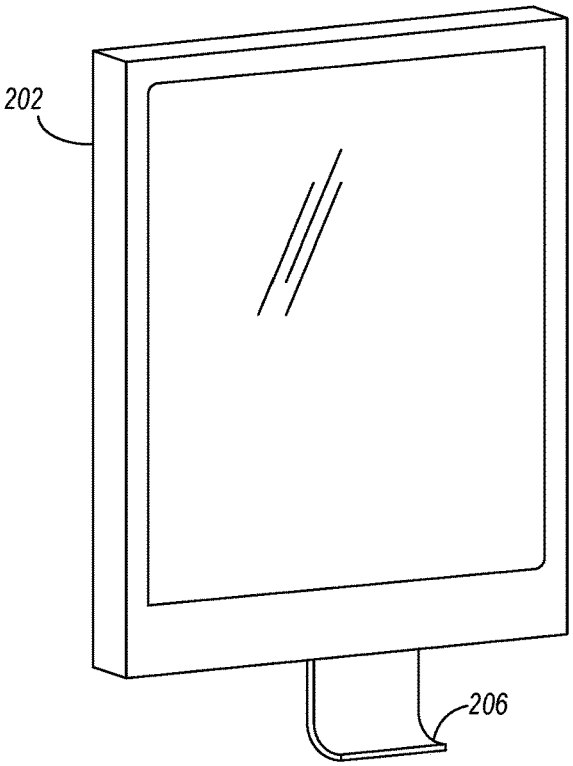
FIG. 4 is a front isometric view of a handheld electronic device with a case attachment having pinky finger extension extended, in accordance with some embodiments.
Figure 5:
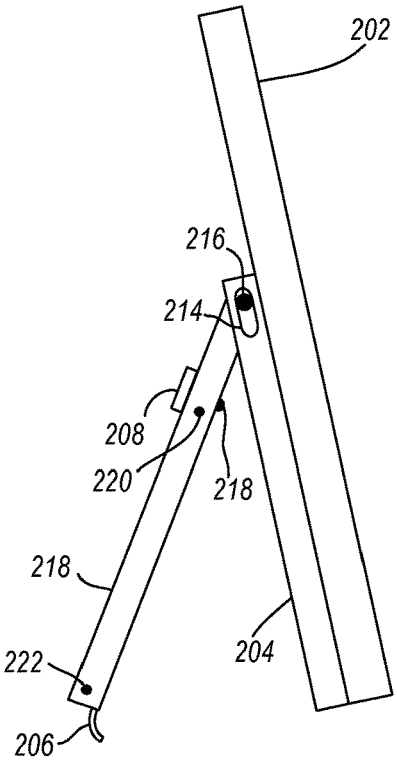
FIG. 5 is a side elevational view a handheld electronic device with a case attachment having pinky finger extension withdrawn, and a pivoting lock portion pivoted to stand the electronic device up on a surface, in accordance with some embodiments.

FIGS. 2-5 show various views of a handheld electronic device with a mechanical case attachment as shown in FIG. 1. FIG. 2 is a side elevational view of a handheld electronic device 202 with a case attachment having pinky finger extension withdrawn. FIG. 3 is a side elevational view of a handheld electronic device 202 with a case attachment having pinky finger extension extended. FIG. 4 is a front isometric view of a handheld electronic device 202 with a case attachment having pinky finger extension extended. FIG. 5 is a side elevational view a handheld electronic device 202 with a case attachment having pinky finger extension withdrawn, and a pivoting lock portion pivoted to stand the electronic device up on a surface. In FIGS. 2 & 3, the handheld electronic device 202 has a mounting plate 204 mounted on a back side of the handheld electronic device 202. The mounting place can be substantially similar to mounting plate 104 of FIG. 1. The mounting plate has opposing slotted holes 214 formed in the walls of the mounting plate 204 at a first or upper end. A stand pivot rod 216 allows a portion of the mechanical case attachment to pivot and swing out to form a stand, as show in FIG. 5. The actuation portion 208 of a button can be depressed or actuated, as indicated by arrow 210 in FIG. 3, causing the sliding tab to move downwards, and the pinky finger extension 206 to be extended (it is withdrawn in FIG. 2). The sliding tab can be spring biased inside the mechanical case attachment as indicated, for example, in FIG. 1, such that actuating the button causes the sliding tab to automatically move downwards, away from the button 208. The pinky finger extension 206 can be a curved, bent, or angled end portion on which the user's pinky finger can rest, while the user's first through third fingers can be behind the handheld electronic device 202, where the mechanical case attachment can provide purchase for holding the device 202, while the user's thumb can be over the front of the device 202 to, for example, operate a touch screen input interface or otherwise interact with the device 202. In FIG. 5, the stand portion 218, in which the sliding tab and button 208 are disposed, is swung out to form a stand to hold the handheld electronic device 202 upright and at an angle for viewing when the device 202 is, for example, on a table or desktop. In this view the button pivot pin 220, half ball bearing 218, and retaining screw 222 can be seen.

Figure 6:
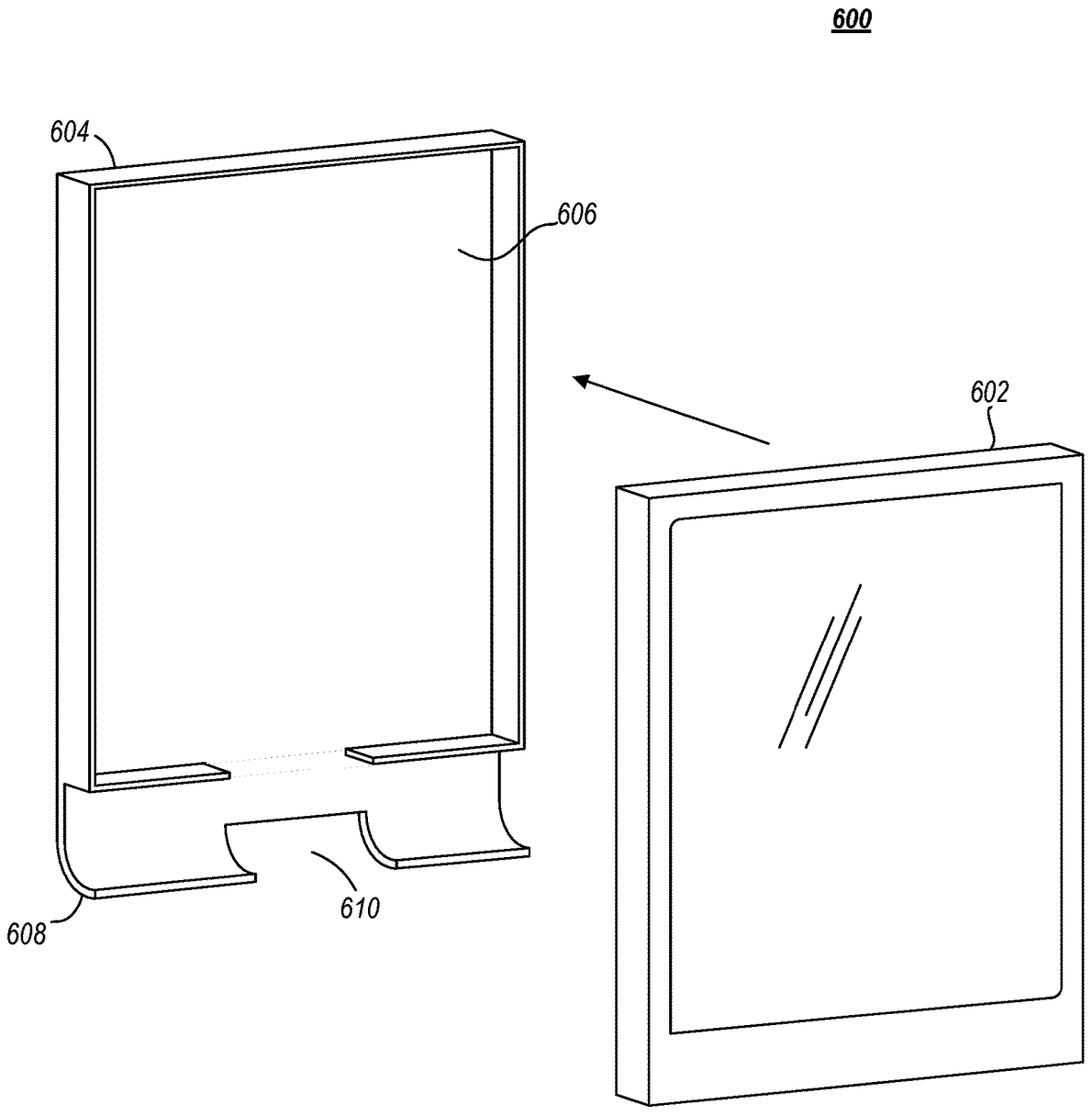
FIG. 6 is a exploded isometric view of a handheld electronic device and a case having an integral pinky finger extension, in accordance with some embodiments.

FIG. 6 is a exploded isometric view 600 of a handheld electronic device 602 and a case 604 having an integral pinky finger extension, in accordance with some embodiments. In such embodiments the handheld electronic device 602 can be disposed into a cavity 606 of the case 604. The case 604 can be made of a resilient material that can stretch over the device 602 and retain the device within the cavity 606. A pinky finger extension 608 can be integrally formed at the bottom of the case 604 to extend beyond the bottom of the handheld electronic device 602 when the device 602 is held in the cavity 606. A cut out portion 610 in the extension 608 can allow access to a bottom connector (not shown) of the device 602 for connecting a charging cable to the device 602, for example. The pinky finger extension 608 allows the user of the handheld electronic device 602 to hold the device 602 with the user's pinky finger over the pinky finger extension 608 and the user's other three fingers behind the case 604, thereby providing a more sure grip on the device/case 602, 604 while operating the device 602.

Figure 8:
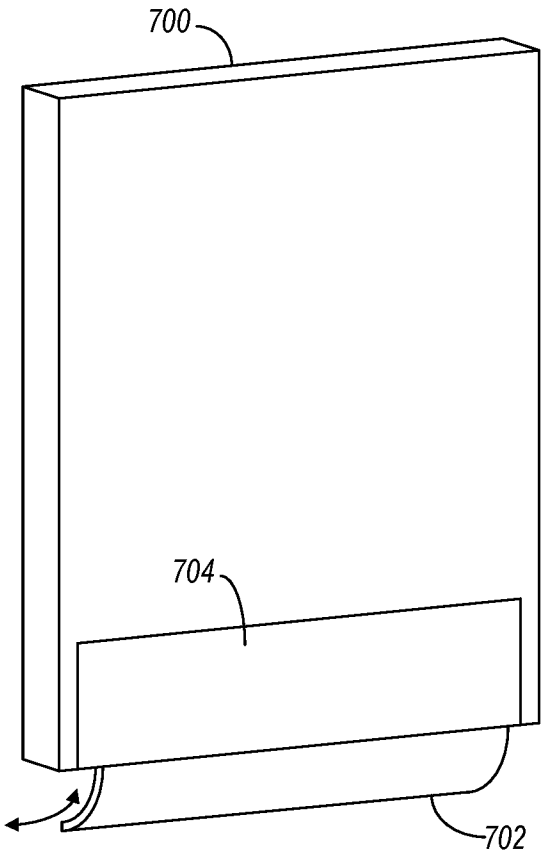
FIG. 8 is a rear isometric view of a handheld electronic device having an integral retractable pinky finger extension, in accordance with some embodiments.
Figure 7:
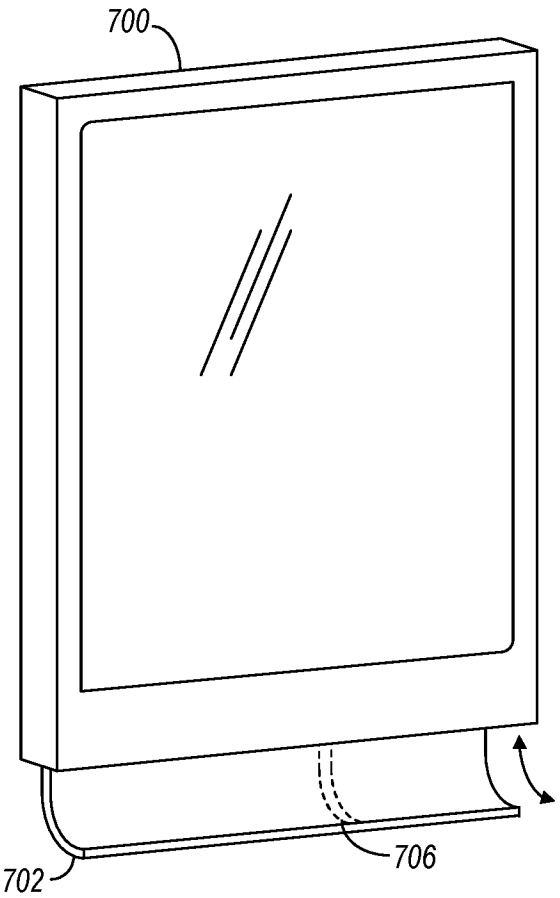
FIG. 7 is a front isometric view of a handheld electronic device having an integral retractable pinky finger extension, in accordance with some embodiments.

FIGS. 7 and 8 show is a front isometric view, and a rear isometric view, respectively, of a handheld electronic device 700 having an integral retractable pinky finger extension 702, in accordance with some embodiments. The pinky finger extension 702 can be contained in a compartment 704 on the back of the handheld electronic device 700, or a case holding the handheld electronic device 700, when not in use. The user can then actuate the pinky finger extension 702, causing it to be deployed from the compartment 704 to be extended for use. As shown here the pinky finger extension 702 comprises a curved surface that curves forward, from the rear of the handheld electronic device 700 towards the front (as seen FIG. 7) of the handheld electronic device 700 at the terminus of the pinky finger extension 702. Alternatively the terminus can be straight, with no deviation towards the front of the handheld electronic device 700, or a planar portion that is angled towards the front of the handheld electronic device 700. As embodied as a curved surface the pinky finger extension can roll in and out of the compartment 704. Alternatively, the pinky finger extension 702 can comprise a sliding tab similar to that of 112 of FIG. 1, the slides along the back plane (i.e. parallel to the plane of the back side) of the handheld electronic device 700. The pinky finger extension 702 can have a width that is nearly as wide as the bottom of the handheld electronic device 700 substantially as shown, or it can be very narrow as indicated by the dashed lines 706. In a narrower embodiment, the pinky finger extension 702/706 can be located anywhere along the width of the bottom of the handheld electronic device 700. Furthermore, the actuation of the pinky finger extension 702 can be purely mechanical, using springs and release/retention elements, as in the embodiment of FIG. 1, or it can be partly or fully automated using electromechanical components to extend and/or withdraw the pinky finger extension 702 by, for example, operating a user interface of the handheld electronic device 700.

Figure 9:
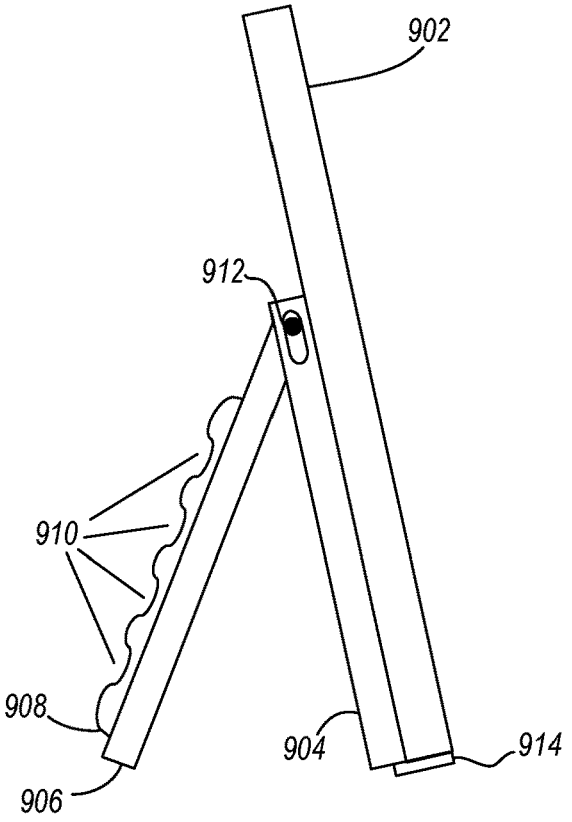
FIG. 9 is a is side elevational view of a handheld electronic device having a pivoting finger grip portion in an extended position, in accordance with some embodiments.
Figure 10:
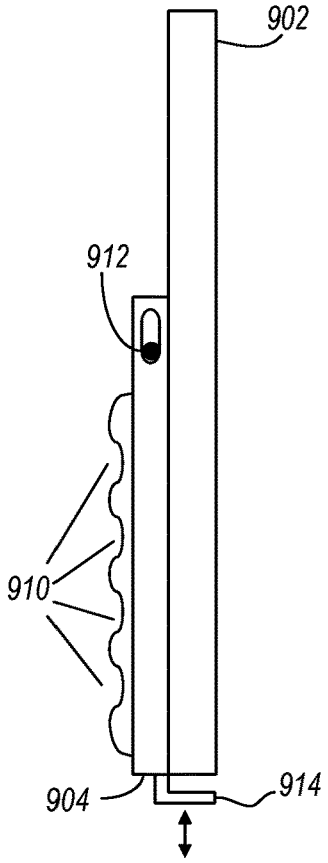
FIG. 10 is a side elevational view of a handheld electronic device having a pivoting finger grip portion in a closed position, in accordance with some embodiments.
Figure 11:
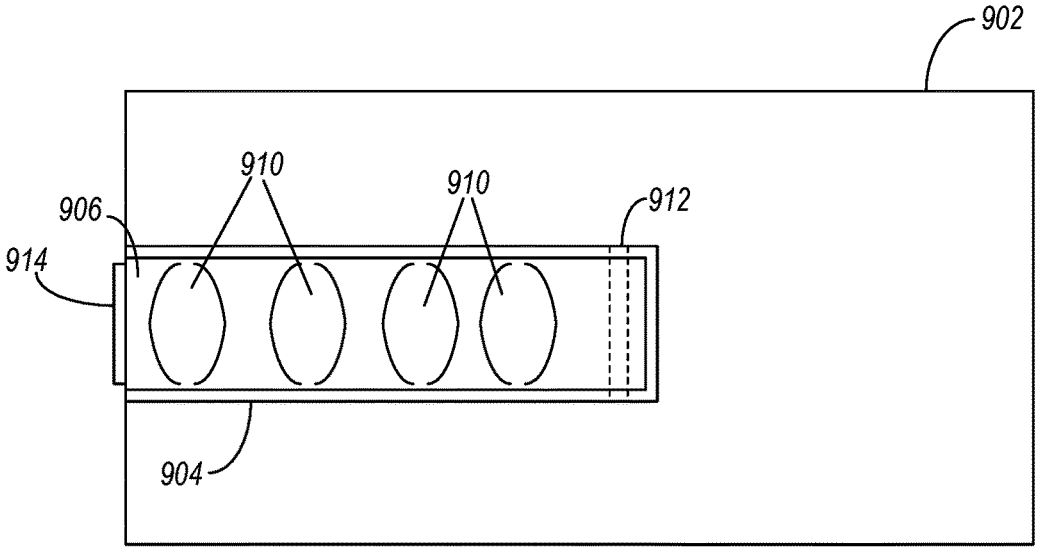
FIG. 11 is a rear view a handheld electronic device having a pivoting finger grip portion in a closed position, in accordance with some embodiments.

FIGS. 9-11 show a handheld electronic device 902 having a pivoting finger grip portion 908 on a stand portion 906 of a mechanical case attachment disposed on the back of the handheld electronic device 902. FIG. 9 shows a side elevational view of the handheld electronic device 902 with the pivoting finger grip portion 908 in an open position for use as a stand; FIG. 10 shows a side elevational view of the handheld electronic device 902 with the pivoting finger grip portion 908 in a closed position; and FIG. 11 is a rear view of the handheld electronic device with the pivoting finger grip portion 908 in a closed position. The finger grip portion 908 is disposed on a stand portion 906 that fits within a mounting plate 904 and is retained therein by stand pivot pin 912, substantially similar to the mounting plate 104 and stand portion 107 of FIG. 1. The finger grip portion 908 is generally a raised portion having one or more depressions for finger grooves 910. In some embodiments the stand portion can further include a sliding tab (similar to sliding tab 112) that forms a pinky finger extension 914 that can be moved in or out of the stand portion 906 to provide further control over the handheld electronic device 902 during operation. As shown here, the pinky finger extension 914 is angled, rather than curved.

Figure 12:
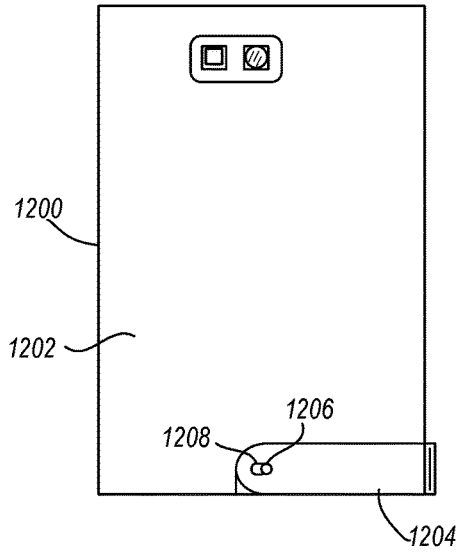
FIG. 12 is a rear elevational view of a handheld electronic device having an integral pivoting pinky finger extension in a closed position, in accordance with some embodiments.
Figure 13:
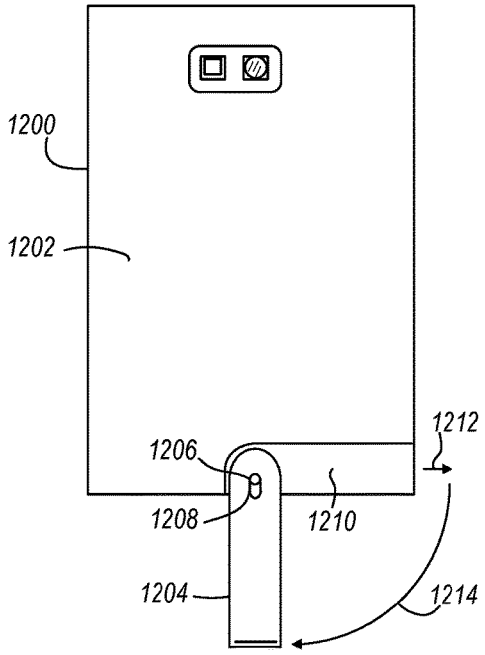
FIG. 13 is a rear elevational view of a handheld electronic device having an integral pivoting pinky finger extension in an open position, in accordance with some embodiments.
Figure 14:
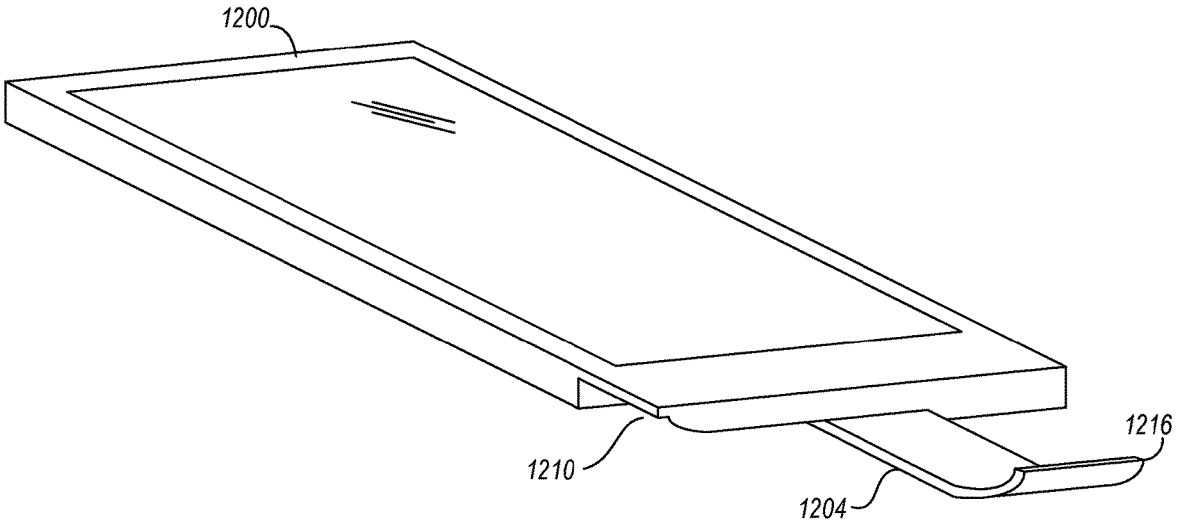
FIG. 14 is a front isometric view of a handheld electronic device having an integral pivoting pinky finger extension in a closed position, in accordance with some embodiments.

FIGS. 12-13 show a pivoting pinky finger extension 1204 that can be disposed integrally on a housing of a handheld electronic device 1200 or on a case holding a handheld electronic device 1200. FIG. 12 shows a rear elevational view of the handheld electronic device 1200 with the integral pivoting pinky finger extension 1204 in the closed position; FIG. 13 shows a rear elevational view of the handheld electronic device 1200 with the integral pivoting pinky finger extension 1204 in an open position; and FIG. 14 shows a front isometric view of a handheld electronic device 1200 with the integral pivoting pinky finger extension 1204 in the open position. The pivoting pinky finger extension 1204 is located on a back surface 1202 of the handheld electronic device 1200, or a case holding the handheld electronic device 1200, and can be held by a post 1206 about which it pivots. A slotted hole 1208 in the pivoting pinky finger extension 1204 can allow locking of the pivoting pinky finger extension 1204 in either the open or closed positions. Alternatively, a mechanical detent can be used equivalently. The pivoting pinky finger extension 1204 can be located in a pocket 1210 that is formed in the back surface 1202 of the handheld electronic device 1200 (or case), and that is sized to accommodate the pivoting pinky finger extension 1204 in the closed position so that it is substantially flush with the back surface 1202. To move the pivoting pinky finger extension 1204 from the closed position (in FIG. 12) to the open position (in FIG. 13), it is first moved slightly to the side, as indicated by arrow 1212, and then pivoted down to the open position, as indicated by arrow 1214. To move it from the open to the closed position, the process is reversed. In FIG. 14 it can be seen that the pivoting pinky finger extension 1204 incorporates an up-curved terminus portion 1216 to help capture the user's pinky finger when held by a user. The terminus portion 1216 can alternatively be simply flat, or angled, and can have a variety of widths.

Figure 15:
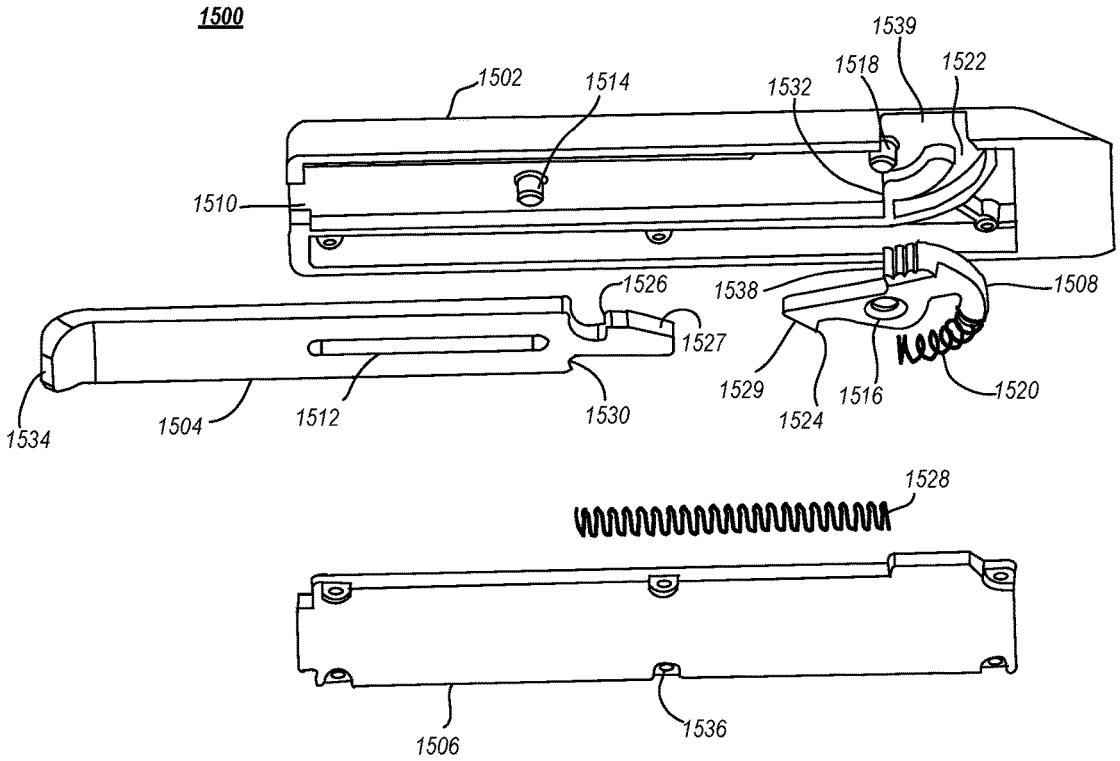
FIG. 15 is an exploded isometric view of a mechanical case attachment for a handheld electronic device, in accordance with some embodiments.

FIG. 15 is an exploded isometric view of a mechanical case attachment 1500 for a handheld electronic device, in accordance with some embodiments. The mechanical case attachment 1500 works similarly to that of FIG. 1, but with a variation of the arraignment of components, and can be pivotally assembled into a mounting plate (not shown) to operate as a stand. In this mechanical case attachment 1500 the top portion 1502 provides a guide channel 1510 in which a sliding tab 1504 is captured and allowed to slide (i.e. to the right and left, as shown on the page). The sliding tab 1504 is further captured in the guide channel 1510 by a longitudinal slot 1512 in the sliding tab 1504 in which a peg or other protrusion supported by the top portion 1502 is disposed. A button component 1508 acts to both retain and deploy the sliding tab 1504, and is pivotably captured on a protrusion 1518 connected or integrally formed in the inside surface of the top portion 1502 via hole 1516 in the button component 1508. An actuation portion 1538, which can be knurled, of the button component 1508 protrudes through an opening 1539 in the side of the top portion 1502, and is biased outward, around protrusion 1518, by a button spring 1520 that is disposed in an arcuate or curved channel 1522 formed in the top portion 1502. The curve of the curved channel 1522 matches an arc of motion about the hole 1516 as the button component 1508 is rotated when the actuation portion 1538 is pressed by a user. The button component 1508 further includes a retention feature 1524 that engages a corresponding retention surface 1526 of the sliding tab 1504. As the sliding tab 1504 is moved inward in the guide channel 1510, an angled surface 1527 pushes against a corresponding surface 1529 of the button component 1508, causing rotational displacement of the button component 1508, compressing button spring 1520, until the surfaces 1527, 1529 move past each other and the force of button spring 1520 causes retention feature 1524 engages retention surface 1526 to retain the sliding tab 1504 in a closed position. A spring such as deployment spring 1528 can be used to urge the sliding tab outward (i.e. to the left of the page) to deploy the sliding tab 1504 to an open position. The deployment spring 1528 can bear against a shoulder 1530 of the sliding tab 1504 and be captured in a channel formed in the top portion 1502 between the shoulder 1530 of the sliding tab 1504 and wall 1532 of the top portion. When the sliding tab is released and deployed to the open position (e.g. extending out of the top portion 1502) the user of the handheld electronic device to which the mechanical case attachment 1500 is mounted can rest their pinky finger on the extension 1534 of the sliding tab 1504, which can be curved or angled to provide further retention capability. A cover or bottom portion 1506 can be used to close the mechanical case attachment 1500 by attaching to the top portion 1502, such as by screws in one or more screw holes 1536 that correspond with screw bosses or other threaded holes in the top portion 1502, thereby further capturing the button component 1508, button spring 1520, sliding tab 1504, and deployment spring 1528 in the top portion 1502.

Figure 16:
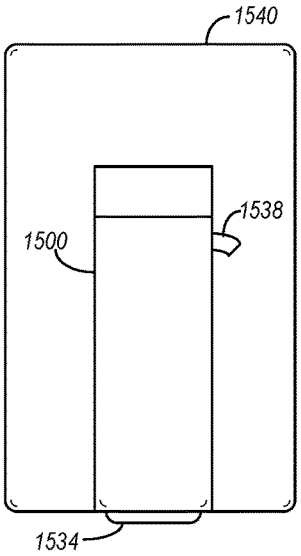
FIG. 16 is a rear elevational view of a handheld electronic device having a mechanical case attachment in a closed position, in accordance with some embodiments.
Figure 17:
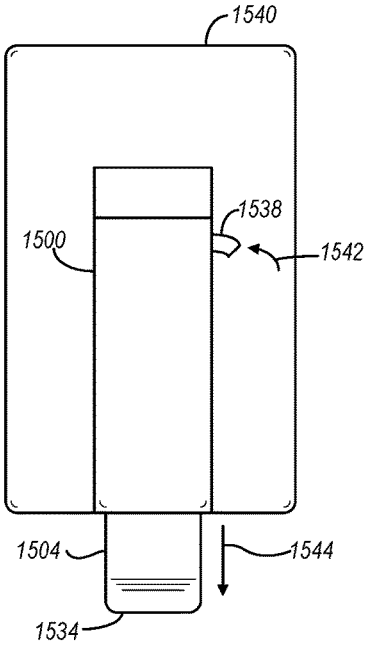
FIG. 17 is a rear elevational view of a handheld electronic device having a mechanical case attachment in an open position, in accordance with some embodiments.

FIGS. 16 and 17 show a rear elevational view of a handheld electronic device 1540 having a mechanical case attachment 1500 in a closed position and in an open position, respectively, in accordance with some embodiments. In the closed position the pinky finger extension 1534 is withdrawn up close to or against the bottom of the handheld electronic device 1540. To deploy the pinky finger extension, the actuation portion 1538 is pressed inward (in the plane of the drawing) as indicated by line 1542. As a result, the sliding tab 1504, of which the pinky finger extension 1534 is the terminal portion, is urged downward by the deployment spring 1528, thereby allowing the user of the handheld electronic device to place their pinky finger over the pinky finger extension 1534 to help retain the handheld electronic device 1540 in the user's hand during operation or when carrying the handheld electronic device 1540. As shown here in FIGS. 16 & 17, the mechanical case attachment can be affixed to the back of the handheld electronic device 1540 by, for example, adhesive, or other mechanical means, or it can be attached to, or part of, a case in which the handheld electronic device is housed. It will be appreciated by those of skill in the art that variations of the elements described herein can be realized without departing from the spirit and scope of the claimed invention. For example, the back of top portion 1502, as seen in FIGS. 16 & 17, can be shaped to have finger grooves such as is show in FIGS. 9-11.

Accordingly, the embodiments of the disclosure provide an enhanced means of holding an operating a handheld electronic device that can include a pinky finger extension or other tab or component that extends beyond the bottom of the handheld electronic device, and allows a user to place their fourth or pinky finger over the extension in order to stabilize the handheld electronic device in the user's hand, as well as provide some measure of retention to avoid accidently dropping the handheld electronic device or having the handheld electronic device slip out of the user's hand. Furthermore, the assembly that holds the pinky finger extension can act as a stand so that, when the user is not hold the handheld electronic device, the user can stand the handheld electronic device up, allowing the user to use both hands for other task while, for example, using the handheld electronic device in a video conferencing function.

In general, embodiments of the disclosure include an apparatus for a handheld electronic device having a pinky finger extension operable to extend beyond a bottom edge of the handheld electronic device and sized to accommodate a pinky finger of a user's hand when the user holds the handheld electronic device in the user's hand. The apparatus further includes a mounting assembly in which the pinky finger extension is mounted and which is attached to the handheld electronic device. The mounting assembly can be, for example, the mounting plate of FIG. 1. In some embodiments the mounting assembly can include an integrally formed pinky finger extension across the bottom width of the handheld electronic device or a case in which it is disposed as in FIG. 6. In some embodiments the mounting assembly can include a compartment on a back side of either the handheld electronic device or a case in which it is disposed, in which the pinky finger extension is mounted and moveable between open and closed positions, as in FIGS. 7-8. In some embodiments the mounting assembly can include a pivot pin about which the pinky finger extension pivots between open and closed positions, as in FIGS. 12-14.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

I claim:

1. An assembly for a handheld electronic device, comprising:

a mounting plate engaged on a bottom surface of the handheld electronic device, the mounting plate having opposing walls with opposing slotted holes at a first end;

a stand portion in pivoting engagement with the mounting plate by a pivot rod extending through the opposing slotted holes;

a top portion disposed over, and coupled to, the stand portion, a guide channel formed between the stand portion and the top portion;

a sliding tab in sliding engagement in the guide channel, the sliding tab having a finger rest that extends in a direction opposite from the first end;

a pivoting button having an actuation portion extending through a surface of the top portion, and which retains the sliding tab in a closed position, and which can be actuated via the actuation portion to disengage the sliding tab to allow the sliding tab to move into an open position where the finger rest is accessible to a user's finger when holding the handheld electronic device; and a spring for biasing the sliding tab away from the first end, and where, upon the pivoting button being actuated, the spring forces the sliding tab away from the first end and into the open position.

2. The assembly of claim 1, wherein the stand portion can be pivoted between a closed position and an open position, where in the open position it provides support to stand the handheld electronic device upright on a surface.

3. The assembly of claim 1, further comprising a finger grip portion, disposed over the top portion, and having grooves sized to accommodate one or more of a user's fingers when holding the handheld electronic device.

4. The assembly of claim 1, wherein the sliding tab comprises a raised portion against which the spring bears, the top portion further comprises a set screw for stopping movement of the sliding tab away from the first end by an interference with the raised portion.

5. The assembly of claim 1, wherein the set screw is disposed in a threaded channel parallel to the movement of the sliding tab, and which, by movement of the set screw, adjusts the distance by which the sliding tab moves away from the first end.

6. The assembly of claim 1, wherein the finger rest further comprises a terminus portion that is curved toward a front of the handheld electronic device.

7. The assembly of claim 1, wherein the finger rest further comprises a terminus portion that is angled toward a front of the handheld electronic device.

8. The assembly of claim 1, further comprising:

a ball bearing element coupled at a distal end of the button spring;

an opening formed in the stand portion corresponding to the location of the ball bearing element; and across slot formed in the mounting plate that is located in correspondence with the opening in the stand portion, thereby providing a mechanism to retain the stand portion in the closed position.

9. An apparatus for a handheld electronic device, comprising:

a pinky finger extension operable to extend beyond a bottom edge of the handheld electronic device and sized to accommodate a pinky finger of a user's hand when the user holds the handheld electronic device in the user's hand; and a mounting assembly in which the pinky finger extension is mounted and which is attached to the handheld electronic device, said mounting assembly further comprising:

a mounting plate engaged on a bottom surface of the handheld electronic device, the mounting plate having opposing walls with opposing slotted holes at the first end;

a stand portion in pivoting engagement with the mounting plate by a pivot rod extending through the opposing slotted holes;

a top portion disposed over, and coupled to, the stand portion, a guide channel formed between the stand portion and the top portion;

a sliding tab in sliding engagement in the guide channel, the sliding tab integrally forming the pinky finger extension and an end opposite from the first end; and a pivoting button having an actuation portion extending through a surface of the top portion, and which retains the sliding tab in a closed position, which can be actuated via the actuation portion to disengage the sliding tab to allow the sliding tab to move into an open position where the pinky finger extension is accessible to the user's pinky finger when holding the handheld electronic device; and a spring for biasing the sliding tab away from the first end, and where, upon the pivoting button being actuated, the spring forces the sliding tab away from the first end and into the open position.

10. The apparatus of claim 9, further comprising:

a button spring coupled to the pivoting button under the actuation portion to bias the actuation portion upwards through a button hole in the top portion;

a ball bearing element coupled at a distal end of the button spring;

an opening formed in the stand portion corresponding to the location of the ball bearing element; and across slot formed in the mounting plate that is located in correspondence with the opening in the stand portion, thereby providing a mechanism to retain the stand portion in the closed position.

11. The apparatus of claim 9, wherein the stand portion can be pivoted between a closed position and an open position, where in the open position it provides support to stand the handheld electronic device upright on a surface.

12. The assembly of claim 9, wherein the sliding tab comprises a raised portion against which the spring bears, the top portion further comprises a set screw for stopping movement of the sliding tab away from the first end by an interference with the raised portion.

13. The assembly of claim 9, wherein the set screw is disposed in a threaded channel parallel to the movement of the sliding tab, and which, by movement of the set screw, adjusts the distance by which the sliding tab moves away from the first end.

* * * * *